US005950552A

United States Patent [19]

Rudoni

[11] Patent Number: 5,950,552

[45] Date of Patent: Sep. 14, 1999

[54] DEVICE FOR CONTROLLING TRANSPORT CLAWS IN SEWING MACHINES PARTICULARLY IN A SEWING MACHINE WITH CYLINDRICAL BASE

[75] Inventor: Franco Rudoni, Buscate, Italy

[73] Assignee: Rimoldi Necchi, Italy

[21] Appl. No.: 09/059,491

[22] Filed: Apr. 13, 1998

[30] Foreign Application Priority Data

May 27, 1997 [IT] Italy ..... MI97A1236

[51] Int. Cl.[6] ..... D05B 27/02

[52] U.S. Cl. ..... 112/323

[58] Field of Search ..... 112/323, 324, 112/169

[56] References Cited

U.S. PATENT DOCUMENTS

| | | | |
|---|---|---|---|
| 1,387,145 | 8/1921 | Flanagan | 112/323 |
| 2,637,288 | 5/1953 | Ceroni | 112/323 X |
| 2,906,220 | 9/1959 | Perla et al. | 112/323 |
| 4,512,273 | 4/1985 | Skogward | 112/323 X |
| 4,691,654 | 9/1987 | Meier | 112/324 X |
| 4,809,628 | 3/1989 | Keinschmidt | 112/323 |
| 5,293,829 | 3/1994 | Mu | 112/323 X |
| 5,337,689 | 8/1994 | Tilders | 112/323 |

*Primary Examiner*—Ismael Izaguirre
*Attorney, Agent, or Firm*—Robert F. I. Conte; Lee, Mann, Smith, McWilliams, Sweeney & Ohlson

[57] ABSTRACT

In a sewing machine with cylindrical base the transport claws are actuated by a device comprising a kinematic transmission mechanism which, through oscillating auxiliary shafts, is connected to a rotating main shaft housed in the foundation to transmit a vertical oscillatory motion to the claws, as well as a lever transmission mechanism which, through transmission levers pivoting according to vertical axes, is interconnected to an auxiliary transport shaft housed in the foundation to transmit a horizontal reciprocating motion to the claws. A reduction in the size of the base of the sewing machine is thus obtained, without thereby penalizing the structural resilience and the operating reliability of the device for the actuation of the transport claws.

20 Claims, 2 Drawing Sheets

FIG 2
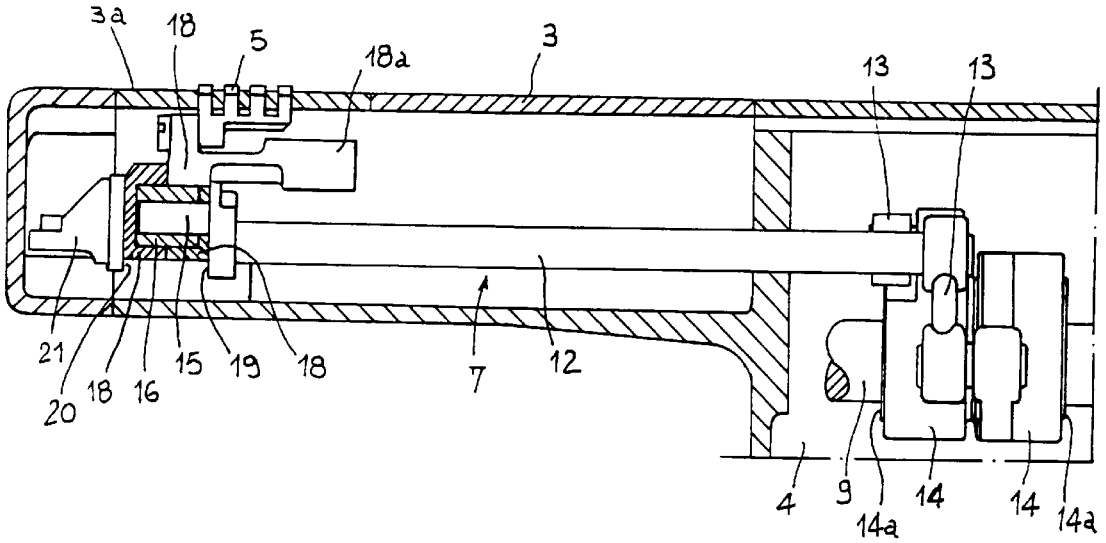
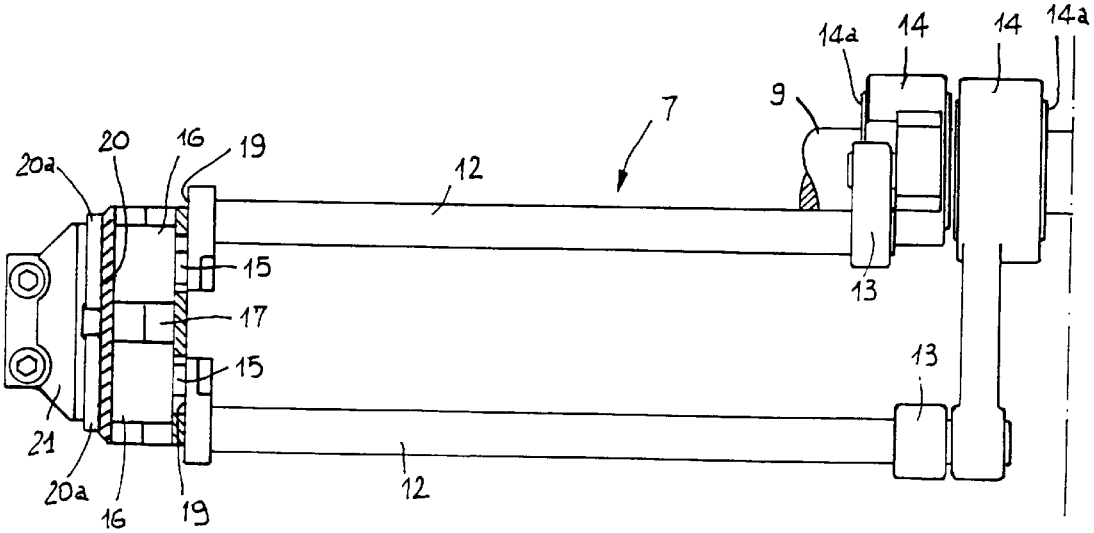
FIG 3

DEVICE FOR CONTROLLING TRANSPORT CLAWS IN SEWING MACHINES PARTICULARLY IN A SEWING MACHINE WITH CYLINDRICAL BASE

BACKGROUND OF THE INVENTION

The present invention relates to a device for controlling transport claws in sewing machines, particularly in a sewing machine with cylindrical base, of the type comprising vertical motion-imparting means operatively connected with a first control shaft to transmit a reciprocating oscillatory motion in an essentially vertical direction and at least one transport claw operatively housed in the base of the sewing machine, horizontal motion-imparting means operatively connected with a second control shaft to transmit to said claw a reciprocating motion in a horizontal direction.

The subject device is especially conceived for use on sewing machine of the type with cylindrical base, whereto particular reference shall be made in the course of the present description. This however does not limit the possibility of employing the subject device also on sewing machines with plane base or of other kinds.

As is well known, machines with cylindrical bases are particular types of sewing machines, mainly used to perform for instance the assembly of cuffs or to finish hems of shirts or trouser legs or, more in general, to perform stitching on articles of tubular shape. To this end, machines of this type are conceived in such a way that the base whereon the article undergoing the work process advances presents dimensions that are as smell as possible, in order to allow working also on tubular articles of small diameter previously fitted around the base itself.

The reduction in the size of the cylindrical base is, however, limited by the need to provide, in the base itself, for sufficient space to house the various organs of the sewing machine.

In this respect, particular importance is taken on by the need to house in the base of the machine the device for controlling the motion of the transport claws, which are assigned the task of making the article advance correctly in the sewing area.

To this end, the claws are supported and actuated by a control device which transmits thereto a cyclical motion according to an essentially elliptical trajectory, in synchrony with the motion of the other organs of the sewing machine.

Currently, devices of this type normally provide for the transport claws to be fastened to respective plate-shaped oscillating supports, mutually paired according to vertical planes and fitted each with two fork-shaped portions oriented from respectively opposite parts.

To the oscillating supports and, hence, to the claws, a vertical oscillatory motion is imparted by means of a pair of eccentrics mounted on respective rotating shafts and operatively engaged in respective lifting blocks each of which is engaged in one of the fork-shaped portions of both oscillating supports, with the possibility of sliding longitudinally.

To the individual oscillating supports is also transmitted a horizontal oscillatory motion in the direction of advance of the cloth, through respective connecting rods mounted on oscillating shafts, driven independently of each other with angular oscillatory motion each around its own axis.

The synchronous combination of the vertical and horizontal oscillations imparted to the claws confers them the aforesaid ellipsoidal cyclic motion, in such a manner that the claws themselves, at each stitch-forming cycle, emerge from the needle plate to drive the article with a longitudinal translation of predetermined amplitude.

The devices described above present considerable efficiency and operating reliability, so much so that their use is widespread in different types of sewing machines.

However, with particular reference to sewing machines with cylindrical base, it should be noted that the size of the control device for the transport claws is a highly critical factor for the purposes of the dimensional containment of the base of the machine itself. When, as occurs in normal cases, a transport device similar to the one normally used on other types of machines, such as plane-base machines, is employed on the cylindrical base machine, it is practically impossible to reduce the dimensions of the cylindrical base below perimeter development values on the order of 250 mm.

Some manufacturers have been able to reduce the size of the claw control device by effecting a sort of "miniaturization" of the components. In these cases, the size of the cylindrical base has been contained to a perimeter development on the order of 180 mm. However, the reduction in the size of the components also entails a reduction in mechanical resilience and in operating reliability, even employing highly sophisticated, and hence highly expensive, materials and work procedures.

It should also be noted that even the cylindrical bases with a development reduced to values on the order of 180 mm do not fully meet the requirements of the market, wherein the ability to work tubular articles of small size on machines with cylindrical base is in ever increasing demand.

SUMMARY OF THE INVENTION

The object of the present invention is essentially to propose a control device which allows to overcome the limitations of the prior art and, more specifically, further to reduce the size of the cylindrical base while still retaining a structure with high resilience that allows fast operation of the machine without penalizing reliability.

These objects and others besides, which will become clearer in the course of the present description, are essentially attained by a control device for transport claws, particularly in a sewing machine with cylindrical base, characterized in that it also comprises at least one lever transmission mechanism associated to said horizontal motion-imparting means to connect operatively said transport claw to said second control shaft inside the base of the sewing machine.

Further features and advantages shall become more readily apparent from the detailed description of a preferred, but not exclusive, embodiment of a device for controlling the transport claws, particularly in a sewing machine with cylindrical base, according to the present invention.

Such description shall be made hereafter with reference to the accompanying drawings provided purely by way of non-limiting indication.

BRIEF DESCRIPTION OF THE DRAWINGS

FIG. 2 shows mainly the device seen from the side and in partial section, highlighting the kinematic transmission mechanism used for the reciprocating vertical motion of the claws;

FIG. 3 is an interrupted and partially sectioned top view of the device shown in FIG. 2.

DESCRIPTION OF THE PREFERRED EMBODIMENT

Figure 1:
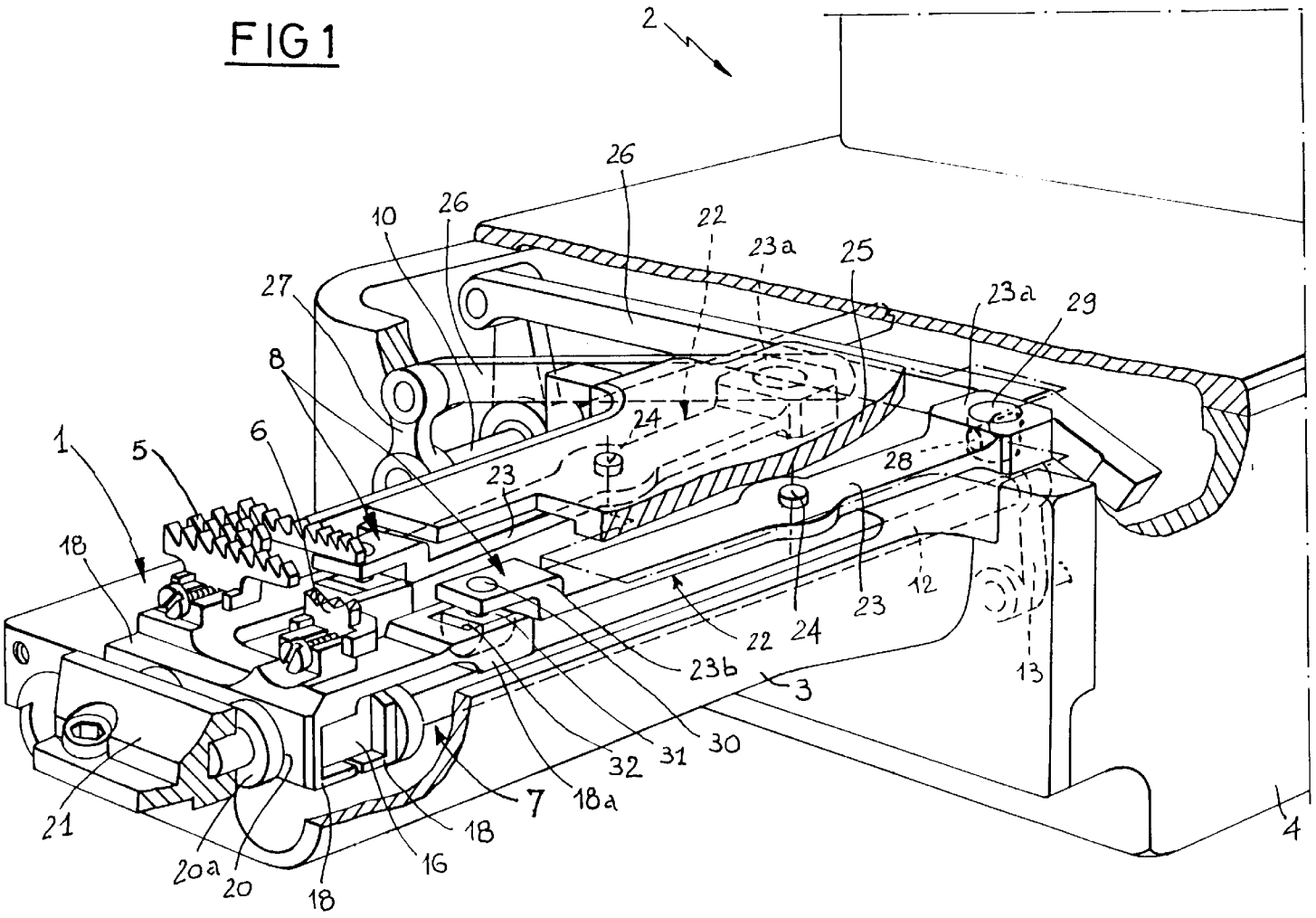
FIG. 1 shows a perspective and partially cut-out view of the subject device mounted in a cylindrical base of a sewing machine.

With reference to the aforementioned figures, the number 1 indicates in its entirety a device for controlling transport claws, particularly in a sewing machine with cylindrical base, according to the present invention.

As can clearly be seen in FIG. 1, the device 1 is suitable for use on a sewing machine 2 of the type with cylindrical base, i.e. presenting a base 3 of essentially cylindrical shape overhanging from a foundation 4. Being in itself known and conventional, such sewing machine shall not be described further, unless it is in reference to some components which present a functional relationship with the subject device.

The device 1 is suited to operate within the base 3 to actuate one or more transport claws 5, 6 which, in a way known in the prior art, operate through a so-called needle plate 3*a* (FIG. 2) to determine the advance of an article undergoing work according to a direction orthogonal to the axis of longitudinal development of the base itself.

To this end, the device 1 essentially comprises vertical motion-imparting means 7 and horizontal motion-imparting means 8 pre-set to transmit to claws 5, 6 a reciprocating oscillatory motion, respectively in an essentially vertical and in an essentially horizontal direction. The combination of the vertical and horizontal oscillations imparted to each of the claws 5, 6 makes the claws themselves perform a cyclic motion according to an essentially elliptical trajectory, in such a way as to emerge from the needle plate, driving the article for a predetermined distance with every stitch-forming cycle.

The vertical and horizontal motion-imparting means 7 and 8 receive their motion respectively from at least one first control shaft 9 (FIGS. 2 and 3) and a second control shaft 10 (FIG. 1) which are advantageously housed in the foundation 4.

To this end, the vertical motion-imparting means 7 comprise at least a kinematic transmission mechanism which operatively connects the transport claws 5, 6 to the first control shaft 9. The kinematic transmission mechanism comprises at least one auxiliary shaft which extends longitudinally in the base 3, i.e. parallel to the longitudinal development of the base itself. In a preferential embodiment, two auxiliary shafts 12 are provided, distanced parallel to one another on a horizontal plane. Each auxiliary shaft 12 is connected to the first control shaft 9 by means of a kinematic transmission mechanism comprising an arm 13 and a connecting rod 14 operatively engaged with an eccentric 14*a* mounted on the control shaft itself.

The kinematic transmission mechanism 13, 14, 14*a* actuates the respective auxiliary shaft 12 with an oscillatory motion reciprocating around its axis, following the rotational actuation of the first control shaft 9, which can for instance be constituted by the main shaft of the sewing machine.

Each auxiliary shaft 12 is fitted with a terminal pin 15 fastened eccentrically from the opposite part with respect to the respective kinematic transmission mechanism 13, 14, 14*a*. The terminal pins 15 are rotationally engaged with respect to the transport claws 5, 6 in mutually distanced points, as can clearly be seen in FIG. 3, in such a way as to maintain the claws themselves constantly oriented according to a plane parallel to the needle plate 3*a*. More specifically, to this end each terminal pin 15 is connected to the claws 5, 6 by means of a respective prism-shaped lifting block 16 slidingly guided with respect to the claws themselves, according to a horizontal direction perpendicular to the axes of the terminal pins themselves and essentially parallel to the direction of advance of the article on the needle plate 3*a*.

More specifically, the lifting blocks 16 are slidingly engaged along a guide seat 17 defined between two support elements 18 bearing respectively the main claw 5 and the differential claw 6. Such support elements are mutually paired and slidingly guided with respect to each other by means of the lifting blocks 16 interposed therebetween. The support elements 18 are also slidingly guided, laterally from respectively opposite parts, between first sliding surfaces 19 borne terminally by the auxiliary shafts 12 and at least a second sliding surface 20 set in the base 3 of the sewing machine 2, in opposite position with respect to the first sliding surfaces 19. In particular, in the embodiment shown, two coplanar slide positions 20 are provided for, obtained on respective sliding shoes 20*a* removably engaged to a striker block 21 fastened in the base 3, in proximity to the free end thereof.

The constructive characteristics of the kinematic transmission mechanism 7 are such that, as a result of the rotatory motion imparted to the first control shaft 9, the auxiliary shafts 12 are driven with angular oscillations around their own axes in such a way that through the eccentric terminal pins 15, the claws 5, 6 are simultaneously subjected to a vertical oscillatory motion maintaining a horizontal orientation parallel to the needle plate 3*a*.

The subject device further provides for the aforesaid horizontal motion-imparting means 8 to be associated at least to one lever transmission mechanism 22 preset to connect operatively the transport claws 5, 6 to the second control shaft 10 housed in the foundation 4. Advantageously, such lever transmission mechanism 22 comprises at least one transmission lever 23 which extends longitudinally within the base, i.e. in a direction essentially parallel to the longitudinal development thereof, and it is oscillatingly fastened with respect to the base itself according to an essentially vertical pivot axis 24. In the preferential embodiment shown, at least two transmission levers 23 are provided, essentially parallel and coplanar with respect to each other, and interconnected respectively to the main transport claw 5 and to the differential transport claw 6.

The transmission levers 23, preferably presenting their cross section flattened essentially in a horizontal plane, as clearly shown in FIG. 1, are oscillatingly mounted in a containment structure 25 removably engaged in the base 3 of the sewing machine 2.

Each transmission lever 23 is connected to the respective claw 5 or 6 and to the second shaft 10 from respectively opposite parts with respect to the corresponding vertical pivot axis 24. More specifically, each lever 23 presents a first end 23*a* connected to the second shaft 10 through a control connecting rod 26 which extends in the foundation 4 in a direction essentially perpendicular to the longitudinal development of the base 3, to connect with the second control shaft itself through an arm 27 fastened thereto.

Preferably, the connection between the first end 23*a* of each transmission lever 23 and the corresponding control connecting rod 26 is obtained by means of a sliding pin 28 rigidly borne by the control connecting rod itself and oriented in a direction essentially parallel to the longitudinal development of the transmission lever 23. The sliding pin 28 is slidingly inserted in a bushing 29 rotationally engaged to the lever 23 according to a vertical axis. The ability of the pin 28 to slide and of the bushing 29 to rotate guarantees compensation for the relative motions that occur between the first end 23*a* of the lever 23 and the control connecting rod 26 during operation.

For the sake of representational clarity, FIG. 1 shows, with a dashed line, only the sliding pin 28 operating on the transmission lever 23 connected to the differential claw 6.

Each lever 23 further presents a second end 23*b* connected to the respective claw 5, 6 through a lateral extension 18*a* of the support element 18 associated to the claw itself.

More specifically, the connection between the second end 23*b* of each lever 23 with the respective claw 5, 6 is obtained through a vertical sliding pin 30 fastened to the lever 23. The vertical pin 30 constrains the transport claw 5, 6 with the possibility to slide, as well as to rotate along a vertical axis. To this end, the vertical pin 30 is slidingly and rotationally inserted in a seat counter-shaped thereto preset in an articulation element 31 fastened to the lateral extension 18*a* of the respective support element 18. Advantageously, the engagement of the articulation element 31 with the respective lateral extension 18*a* is such that the transmission lever 23 is connected to the transport claw 5, 6 with freedom to slide in a direction parallel to the longitudinal development of the transmission lever itself, as well as with the possibility to rotate angularly around an axis parallel to the longitudinal development of the lever itself. To this end, the articulation element 31 presents an essentially semi-cylindrical shape, and it is operatively housed in a slot 32 having extended configuration according to the longitudinal development of the transmission lever 23 and with a cross section profile that is counter-shaped to the articulation element 31.

Advantageously, the aforesaid connection with freedom to slide and rotate vertically, as well as to slide and rotate longitudinally, allows to compensate for the relative motions that, during operation, manifest themselves between the end 23*b* of each lever 23 and the lateral extension 18*a* of the respective support element 18, due to the arched trajectory traced by the end 23*b* around the vertical axis of oscillation 24, as well as to the oscillation transmitted to the claws 5, 6 by the action of the vertical motion-imparting means 7. The structural design of the lever transmission mechanism 22 described above is such that the angular oscillatory motion performed by the second control shaft 10, which may for instance comprise the so-called "oscillating transport shaft" usually provided for in sewing machines, is transmitted to the first end 23*a* of each lever 23, so that the levers themselves are actuated with angular oscillatory motion around the respective vertical axes 24. The angular oscillation of the levers 23 is hence transmitted, through the respective second ends 23*b*, to the individual claws 5, 6 which, being guided according to a rectilinear trajectory along the lifting blocks 16 and between the guide surfaces 19 and 20, consequently perform a reciprocating motion in the longitudinal sense. In a way known in itself, this horizontal reciprocating motion combines with the oscillation transmitted by the vertical motion-imparting means 7, conferring to the claws 5, 6 a cyclical motion according to an essentially elliptical trajectory.

In a way known in itself, between the control connecting rods 26 and the arms 27 can be interposed suitable regulating organs, not shown because they are known in the prior art, set to regulate the amplitude of the horizontal oscillations performed by the individual transport claws 5, 6.

The present invention thus attains the proposed objects.

It is noted that the employment of the kinematic transmission mechanism and of the lever transmission mechanism 22 has allowed to retain the main shaft 9 and the oscillating transport shaft 10 inside the foundation, transmitting the motion to the transport claws 5, 6 by means of auxiliary shafts 12 and transmission levers 23 with reduced dimensions and positioned in such a way as to allow a considerable reduction in the size of the device within the cylindrical base 3. Thus it was possible considerably to reduce the dimensions of the base 3, to a perimeter development on the order of 160 mm.

Therefrom stems an advantageous enhancement to the possibilities of employment of the cylindrical-base machine which can be used to perform work even on tubular articles of extremely reduced sizes, such as sleeves for children's sweatshirts.

It should further be observed that the structure of the subject device offers excellent guarantees in terms of structural resilience and operating reliability.

In this regard, it is noted that the use of the auxiliary shafts oscillating with the respective eccentric pins for the purposes of the reciprocating vertical motion allows to transmit to the claws vertical forces of relatively high intensity, suitable to overcome the thrust imparted by the pressure shoe on the article undergoing work.

Moreover, the flattened configuration and the coplanar disposition of the transmission levers used to transmit horizontal oscillations represents an optimal solution for the exploitation of the space available inside the base of the machine. Additionally, the conformation of the levers 23, flattened according to a horizontal plane, allows effectively to tolerate the flexure stresses transmitted to the levers themselves during operations.

The design solutions adopted for the interconnection of the transmission levers with the respective control connecting rods and with the claws is also advantageous to the functional reliability of the device and to the mechanical resilience of its components.

It should be noted that the use of the subject device allows to attain operating speeds exceeding 5,500 rpm, thereby increasing by about 20% the operating speed normally attained with prior-art devices used in sewing machines with cylindrical base having circumferential development on the order of 180 mm.

What is claimed:

1. A device for controlling transport claws, in a sewing machine with cylindrical base, said sewing machine comprising a foundation and said base having transversional dimensions, smaller than the foundation and a base overhanging from the foundation, said control device comprising:

means for imparting vertical motion operatively connected with a first control shaft to transmit a reciprocating oscillatory motion in an essentially vertical direction to at least one transport claw operatively housed in the base of the sewing machine;

means for imparting horizontal motion operatively connected with a second control shaft to transmit to said claw a reciprocating motion in a horizontal direction;

wherein the improvement comprises at least one lever transmission mechanism associated to said horizontal motion-imparting means to connect operatively said transport claw to said second control shaft within the foundation of the sewing machine.

2. The device according to claim 1, wherein said lever transmission mechanism comprises at least one transmission lever extending longitudinally inside the base of the sewing machine and oscillatingly constrained with respect to said base according to an essentially vertical pivot axis.

3. The device according to claim 2, further comprising at least one control connecting rod extending in the foundation of the sewing machine in a directional essentially perpendicular to said base to interconnect the transmission lever with said second control shaft.

4. The device according to claim 3, wherein said transmission lever is connected to the respective control connecting rod by means of a sliding pin essentially parallel to the longitudinal development of the transmission lever, slidingly engaged in a bushing able to revolve around a vertical axis.

5. The device according to claim 2, wherein said at least one transmission lever presents its cross section flattened essentially in a horizontal plane.

6. The device according to claim 2, wherein said at least one transmission lever is oscillatingly mounted in a containment structure removably engaged in the base of the sewing machine.

7. The device according to claim 2, wherein said at least one transport claw is slidingly guided with respect to the transmission lever by means of at least one vertical sliding pin.

8. The device according to claim 7, wherein said vertical sliding pin connects the transmission lever to the respective transport claw rotationally around a vertical axis.

9. The device according to claim 2, wherein said transmission lever is connected to the transport claw with freedom to slide in a direction parallel to the longitudinal development of the transmission lever.

10. The device according to claim 2, wherein said transmission lever is connected to the transport claw with freedom to rotate angularly around an axis parallel to the longitudinal development of the transmission lever.

11. The device according to claim 2, further comprising at least two of said transmission levers essentially parallel to each other and interconnected respectively to a main transport claw and to a differential transport claw.

12. The device according to claim 11, wherein said auxiliary shaft is operatively connected to said at least one transport claw by means of a terminal pin eccentrically fastened to the shaft itself and engaging rotationally with respect to the claw itself.

13. The device according to claim 12, wherein said terminal pin is connected to said at least one transport claw by means of a lifting block slidingly guided with respect to the clamp according to a horizontal direction perpendicular to the axis of the terminal pin itself.

14. The device according to claim 13, further comprising a main transport claw and a differential transport claw fastened to respective support elements mutually paired to define a guide seat for said lifting block.

15. The device according to claim 14, wherein said paired support elements are slidingly guided with respect to each other, between at least a first sliding surface obtained at the end of said at least one auxiliary shaft and at least a second sliding surface set in the base of the sewing machine in opposite position with respect to said first sliding surface.

16. The device according to claim 1, wherein said transmission lever is operatively connected to the claw and to the second control shaft from respectively opposite parts with respect to a vertical pivot axis.

17. The device according to claim 1, further comprising at least one kinematic transmission mechanism associated to said vertical motion-imparting means whereby said transport claw is operatively connected to said first control shaft within the foundation of the sewing machine.

18. The device according to claim 17, wherein said kinematic transmission mechanism comprises at least one auxiliary shaft extending longitudinally in the base of the sewing machine and able to be actuated with reciprocating oscillatory motion around its own longitudinal axis.

19. The device according to claim 18, further comprising two of said auxiliary shafts, parallel, fitted with respective terminal pins engaging said at least one transport claw in mutually distanced points.

20. A device for controlling transport claws in a sewing machine comprising said sewing machine having a foundation and a cylindrical base connected to the foundation and said cylindrical base having a circumference less than the dimensions on said foundation, said control device having at least one transport claw operatively housed in the cylindrical base, a control shaft to transmit a reciprocating oscillatory motion in an essentially vertical direction to said at least one transport claw, means for imparting vertical motion operatively connected to said control shaft, a second control shaft to transmit to said claw a reciprocating motion in a horizontal direction, means for imparting horizontal motion operatively connected to said second control shaft to transmit to said claw the reciprocating motion in the horizontal direction, and at least one lever transmission mechanism associated to said horizontal motion-imparting means to operatively connect within the foundation of the sewing machine, said transport claw to said second control shaft.

* * * * *